United States Patent [19]

Lage

[11] 4,233,903

[45] Nov. 18, 1980

[54] SHOTGUN SHELL

[76] Inventor: Frederick A. Lage, Rte. 2, Gladbrook, Iowa 50635

[21] Appl. No.: 4,023

[22] Filed: Jan. 17, 1979

[51] Int. Cl.[3] ..... F42B 7/00

[52] U.S. Cl. ..... 102/42 R; 102/43 P

[58] Field of Search ..... 102/38 R, 42 R, 42 C, 102/43 R, 43 P

[56] References Cited

U.S. PATENT DOCUMENTS

| | | | |
|---|---|---|---|
| 2,180,239 | 11/1939 | Holland et al. | 102/42 R |
| 3,127,837 | 4/1964 | Lockwood | 102/42 R |
| 3,359,903 | 12/1967 | Sobolewski | 102/43 R |
| 4,085,677 | 4/1978 | Marcenkiewicz | 102/42 R |

*Primary Examiner*—Harold J. Tudor

*Attorney, Agent, or Firm*—Zarley, McKee, Thomte, Voorhees & Sease

[57] ABSTRACT

A shotgun shell is described which reduces recoil while increasing muzzle velocity. The shell comprises a first cylindrical base portion having an enlarged rim at its rearward end with a second cylindrical portion extending forwardly from the forward end of the first cylindrical portion. The second cylindrical portion has a diameter less than the diameter of the first cylindrical portion. A third cylindrical portion extends forwardly from the forward end of the second cylindrical portion and is designed to receive a shot cup containing shot therein. A powder chamber is formed in the shell and communicates with a central opening formed in the rearward end of the shell. A primer is positioned in the central opening for communication with the powder chamber through a small opening at the forward end of the central opening. The powder chamber has a cylindrical rearward portion and an outwardly and forwardly extending tapered portion at its forward end. The reduced diameter of the second cylindrical portion expands laterally during detonation of the shell so as to reduce the recoil. The small opening or hole between the central opening and the powder chamber shields the primer during detonation and prevents the primer from being blown rearwardly from the shell during detonation.

9 Claims, 4 Drawing Figures

SHOTGUN SHELL

BACKGROUND OF THE INVENTION

This invention relates to a shotgun shell and more specifically to an improved shotgun shell having reduced recoil and increase muzzle velocity.

In gas operated shotguns, the spent shell is ejected by a mechanism which is actuated by the recoil within the gun. A problem which is experienced in the gas operated shotguns is that the primer tends to be blown rearwardly from the shell during detonation which frequently causes jamming or other malfunctions of the gun.

Another disadvantage in conventional shotgun shells is that the recoil caused by the detonation becomes a factor for those shooters who shoot a large number of shells over a short period of time such as trap shooters or the like. Attempts have been made to reduce the recoil but those attempts apparently have met with little success since the shells presently available still exhibit considerable recoil.

Therefore, it is a principal object of the invention to provide an improved shotgun shell.

A still further object of the invention is to provide a shotgun shell having means for preventing the primer from being blown therefrom during detonation.

A still further object of the invention is to provide an improved shotgun shell having reduced recoil and increase muzzle velocity.

A still further object of the invention is to provide a shotgun shell which is economical of manufacture and refined in appearance.

These and other objects will be apparent to those skilled in the art.

SUMMARY OF THE INVENTION

Figure 1:
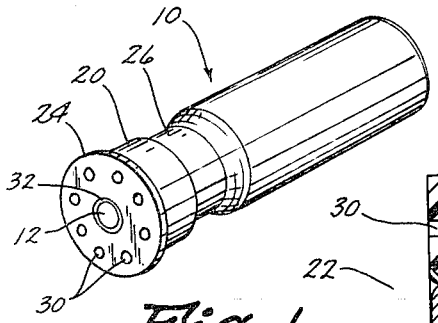
FIG. 1 is a rear perspective view of the shell of this invention.

An improved plastic shotgun shell is described which exhibits decreased recoil and improved muzzle velocity. The shotgun shell has a reduced neck portion adjacent its rearward end which expands during detonation to reduce recoil. The shell also has a plurality of forwardly extending bores formed in its rearward end which tend to prevent shrinking of the shell during the cooling thereof during manufacture and which also are believed to help reduce the recoil of the shell. Means is provided forwardly of the primer opening so as to shield the primer during detonation to prevent the primer from being blown rearwardly from the shell during the detonation. The configuration of the powder chamber is such that improved powder combustion is achieved.

DESCRIPTION OF THE PREFERRED EMBODIMENT

The shotgun shell of this invention is referred to generally by the reference numeral 10 and is comprised of a medium density polyethylene material. As seen in the drawings, the shell casing is of unitary construction and is adapted to receive a primer 12, powder 14, shot sleeve 16 and shot 18.

Figure 2:
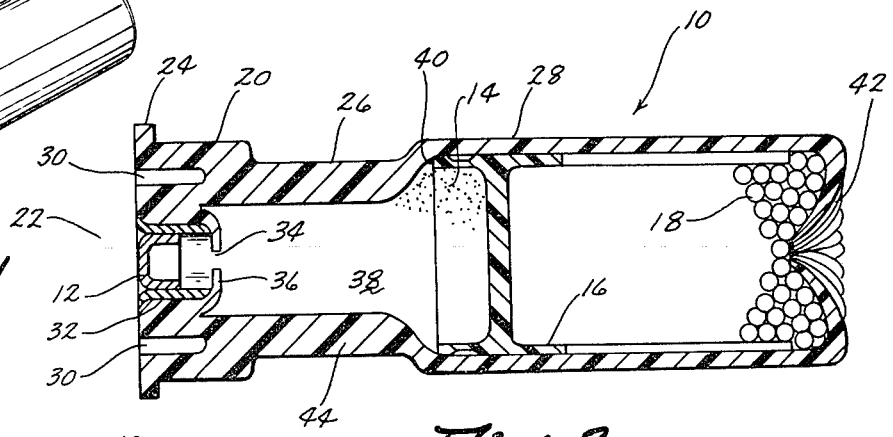
FIG. 2 is a longitudinal sectional view of the shell.
Figure 3:
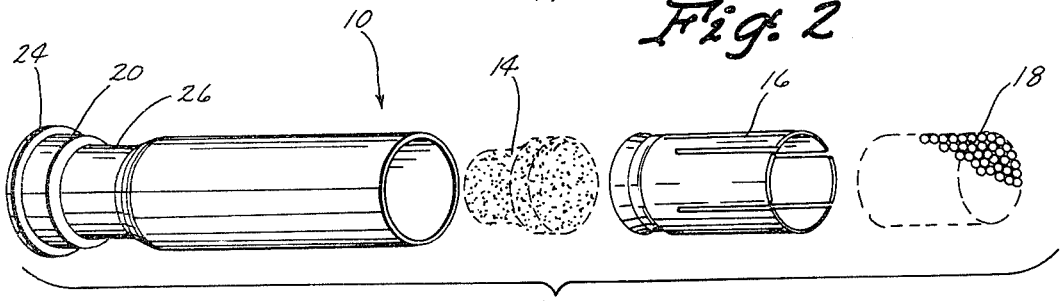
FIG. 3 is an exploded perspective view of the shell.

Shell 10 is provided with a cylindrical portion 20 at its rearward end 22. As seen in FIG. 2, cylindrical portion 20 is provided with a rim portion 24 at its rearward end. Cylindrical portion 26 extends forwardly from the forward end of cylindrical portion 20 and has a diameter less than cylindrical portion 20 as best seen in FIG. 2. Cylindrical portion 28 extends forwardly from the forward end of cylindrical portion 26 and has the same diameter as cylindrical portion 20.

The shell 10 is provided with a plurality of elongated bores 30 which extend forwardly into the rearward end thereof as illustrated in FIGS. 1 and 2. The bores 30 aid in preventing the base portion or rearward portion of the shell from shrinking during cooling after molding. If the holes are not provided, the base portion of the shell tends to lose its shape and become tapered during cooling. With the holes or openings 30, the base portion of the shell retains its shape. It is also believed that the openings 30 also provide a certain amount of cushion during detonation which reduces the recoil of the detonation.

Shell 10 is provided with a central opening 32 which extends inwardly or forwardly from the rearward end and which is designed to receive the primer 12. The forward end of opening 32 is provided with a small hole or reduced diameter portion 34. The opening 34 is defined by an annular shoulder 36. It can be seen in FIG. 2 that the annual shoulder 36 substantially shields the primer 12 during detonation of the powder within the powder chamber 38. The shielding of the primer prevents the primer from being blown rearwardly from the shell during detonation in the gas operated shotguns.

Powder chamber 38 is generally cylindrical shaped at its rearward end but tapers outwardly and forwardly at its forward end until it reaches the rearward end of cylindrical portion 28. The configuration of the powder chamber 38 is very important since the powder chamber is smaller at its primer end thereby slowing down ignition. The configuration of the powder chamber is such that ignition of the powder creates a pushing effect on the shot rather than one sudden explosion.

Shot cup 16 is positioned within cylindrical portion 26 and it can be seen that the rearward end 40 of the shot cup 16 engages the wall surface extending around the tapered forward end of powder chamber 38 to limit the inward movement of the cup or sleeve 16 during loading operations. Cup 16 has the shot 18 contained therein with the powder, sleeve 16 and shot 18 being maintained in the shell by the crimp 42.

The shell 10 is conventionally loaded so that the primer 12 is positioned in the central opening 32 and so that the powder 14 is placed in the powder chamber 38. The shot sleeve 16 is then positioned within the shell with the shot 18 being positioned within the sleeve 16. The shell is then crimped at 42.

The shell is detonated by causing a striking blow to be delivered to the primer 12 which ignites the powder in chamber 38. As previously described, the configuration of the chamber 38 is such that the combustion of the powder is slowed somewhat thereby creating a pushing effect on the shot sleeve and shot therein rather than one sudden explosion. During detonation, the wall surface generally depicted by the reference numeral 44 expands laterally since it does have a reduced diameter portion as compared to cylindrical portion 20 and 28.

Figure 4:
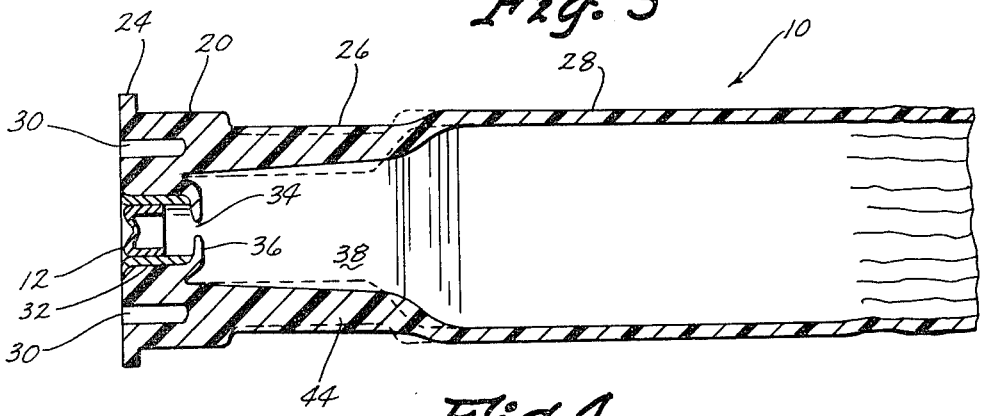
FIG. 4 is a sectional view similar to FIG. 2 except that the shell has been fired.

Expansion or lateral movement of the shell at 44 greatly reduces the recoil of the shell. FIG. 4 illustrates the configuration of the shell after detonation. The dotted lines adjacent the cylindrical portion 26 in FIG. 4 illustrate the former position of the cylindrical portion 26 and it can be seen that expansion has occurred. The interior wall surface of powder chamber 38 also moves from the broken line position to the solid line position in FIG. 4.

The shell 10 is preferably comprised of a medium density polyethylene such as HHM-4903-03-7-2546 manufactured by Phillips Petroleum Co.

Thus it can be seen that a novel shotgun shell has been provided which not only reduces recoil but which improves muzzle velocity. The improved muzzle velocity is believed to be achieved inasmuch as there is no need for wads in the shell of this invention. The elimination of wads in the shell results in less recoil and increased velocity. Thus it can be seen that the shotgun shell of this invention accomplishes at least all of its stated objectives.

I claim:

1. A shotgun shell having rearward and forward ends comprising, a first cylindrical base portion having an enlarged rim at its rearward end, a second cylindrical portion extending forwardly from said first cylindrical portion and having an outside diameter less than said first cylindrical portion, a third cylindrical portion extending forwardly from said second cylindrical portion and having an outside diameter substantially equal to the outside diameter of said first cylindrical portion and having a length substantially greater than the length of said first and second cylindrical portions, said base portion having a central opening formed in its rearward end for receiving a primer therein, at least said second cylindrical portion defining a powder chamber which communicates with said central opening, at least said third cylindrical portion defining a shot compartment, said powder chamber and said second cylindrical portion defining a wall portion capable of expanding laterally outwardly during the firing of the shotgun shell to reduce the recoil created by said firing.

2. The shotgun shell of claim 1 wherein said central opening has a reduced diameter portion at its forward end for shielding the primer in said central opening rearwardly of said reduced diameter portion during said firing.

3. The shotgun shell of claim 1 wherein a plurality of spaced-apart bores extend forwardly into the rearward end of said base portion from the rearward side thereof.

4. The shotgun shell of claim 3 wherein said bores are spaced radially outwardly from said central opening and circumferentially spaced apart relative to one another.

5. The shotgun shell of claim 1 wherein said second cylindrical portion defining said powder chamber has a smaller diameter at its primer end than at its forward end for enhancing combustion of the powder therein.

6. The shotgun shell of claim 1 wherein a shot sleeve is positioned within said third cylindrical portion.

7. The shotgun shell of claim 1 wherein said shell is comprised of unitary thermoplastic material.

8. The shotgun shell of claim 5 wherein said powder chamber comprises a generally cylindrical shaped rearward chamber portion and a forward chamber portion which extends forwardly and outwardly from the forward end of said rearward chamber portion.

9. The shotgun shell of claim 8 wherein said forward chamber portion is defined by a tapered outer wall, a shot sleeve positioned within said third cylindrical portion, the rearward end of said shot sleeve engaging said tapered outer wall to limit inward movement of the shot sleeve with respect to said shell during loading operations.

* * * * *